US005690064A

United States Patent [19]

Izuo

[11] Patent Number: 5,690,064

[45] Date of Patent: Nov. 25, 1997

[54] ELECTROMAGNETIC VALVE DRIVING APPARATUS FOR DRIVING A VALVE OF AN INTERNAL COMBUSTION ENGINE

[75] Inventor: Takashi Izuo, Toyota, Japan

[73] Assignee: Toyota Jidosha Kabushiki Kaisha, Toyota, Japan

[21] Appl. No.: 528,450

[22] Filed: Sep. 14, 1995

[30] Foreign Application Priority Data

Sep. 22, 1994 [JP] Japan ..... 6-228164

[51] Int. Cl.[6] ..... F01L 9/04

[52] U.S. Cl. ..... 123/90.11; 251/129.16

[58] Field of Search ..... 123/90.11; 251/129.07, 251/129.01, 129.09, 129.1, 129.16

[56] References Cited

U.S. PATENT DOCUMENTS

| | | | |
|---|---|---|---|
| 4,455,543 | 6/1984 | Pischinger | 251/129 |
| 5,269,269 | 12/1993 | Kreuter | 123/90.11 |
| 5,339,777 | 8/1994 | Cannon | 123/90.11 |
| 5,350,153 | 9/1994 | Morinigo et al. | 251/129.16 |

FOREIGN PATENT DOCUMENTS

| | | | |
|---|---|---|---|
| 0024909 | 3/1981 | European Pat. Off. . | |
| 43426 | 1/1982 | European Pat. Off. . | |
| WO 95/00787 | 1/1995 | European Pat. Off. . | |
| 2630512 | 12/1978 | Germany | 123/90.11 |
| 3500530 | 7/1986 | Germany | 123/90.11 |
| 3826977 | 8/1988 | Germany . | |
| 58-183805 | 10/1983 | Japan . | |
| 61-237810 | 10/1986 | Japan . | |
| 63-277810 | 11/1988 | Japan . | |
| 1-227808 | 9/1989 | Japan . | |
| 4-502191 | 4/1992 | Japan . | |
| 7-502098 | 3/1995 | Japan . | |
| 1121469 | 10/1984 | U.S.S.R. | 123/90.11 |

*Primary Examiner*—Erick R. Solis
*Attorney, Agent, or Firm*—Kenyon & Kenyon

[57] ABSTRACT

An electromagnetic valve driving apparatus which drives a valve of an internal combustion engine by using an electromagnetic attractive force. The electromagnetic valve apparatus includes a plunger holder which is fixed to the valve, and a plunger which is fixed to the plunger holder. The plunger allows more magnetic flux to flow than the plunger holder.

21 Claims, 5 Drawing Sheets

ELECTROMAGNETIC VALVE DRIVING APPARATUS FOR DRIVING A VALVE OF AN INTERNAL COMBUSTION ENGINE

BACKGROUND OF THE INVENTION (1) Field of the Invention

The present invention generally relates to an electromagnetic valve driving apparatus for driving a valve of an internal combustion engine and, more particularly, to an electromagnetic driving apparatus for driving an intake valve or an exhaust valve of an internal combustion engine by an electromagnetic force.

(2) Description of the Related Art

An electromagnetic valve driving apparatus is known as disclosed in Japanese Patent Laid-open No.61-237810 in which an intake valve or an exhaust valve of an internal combustion engine is driven by an electromagnetic attractive force generated by solenoid coils. The valve apparatus eliminates a cam mechanism for driving an intake valve and an exhaust valve, generally used in the prior art. Additionally, the timing for opening and closing the valve can be arbitrarily changed. Thus, an ideal opening and closing timing corresponding to operating conditions of the internal combustion engine can be easily realized.

The valve apparatus discussed above comprises a valve rod connected with an intake valve or an exhaust valve, a round-shaped plunger formed of magnetic material which is fixed on the valve rod, two solenoid coils which are placed above and below the plunger, respectively, and two magnetic cores each of which is attached to a respective one of the solenoid coils.

When an current is supplied to one of the solenoid coils, an electromagnetic attractive force is generated between the plunger and the magnetic core which is attached to the solenoid coil being supplied with the current. Thus, the plunger moves toward the magnetic core which is being supplied with the current due to the electromagnetic attractive force. On the other hand, when a current is supplied to the other solenoid coil, the plunger moves in the opposite direction. Therefore, when the current is alternatively supplied to the two solenoid coils, the plunger is reciprocated between the two solenoid coils, and, thereby, the valve connected with the plunger via the valve rod is reciprocated between an open position and a close position.

Incidentally, the plunger of the valve driving apparatus is a flat plate formed of a magnetic material. Thus, the magnetic flux generated by the solenoid coil flows to almost all portions of the plunger. On the other hand, it is preferable to concentrate the magnetic flux at a portion of the plunger closest to the magnetic core. That is, in the above-mentioned valve apparatus, since the magnetic flux is not concentrated at the portion closest to magnetic core, there is a problem in that the current necessary to obtain a predetermined electromagnetic attractive force is increased.

Moreover, when the magnetic flux flows through a magnetic circuit comprising the magnetic core, the plunger, and an air gap between the core and the plunger, the magnetic-flux density is not the same at all portions of the plunger. However, the magnetic flux capacity of the plunger is the same at all portions of the plunger. That is, in the above-mentioned valve apparatus, since the plunger has an unnecessary thickness at portions where a comparatively small magnetic flux flows, there is a problem in that the weight of the plunger is increased to obtain enough magnetic flux capacity.

SUMMARY OF THE INVENTION

It is a general object of the present invention to provide a novel and useful electromagnetic valve driving apparatus for driving a valve of an internal combustion engine in which the problems discussed above are eliminated.

A more specific object of the present invention is to provide an electromagnetic valve driving apparatus which is operated by a small amount of electric current by using a plunger in which a magnetic flux is concentrated at a portion which is closest to the magnetic core.

The above-mentioned objects of the present invention are achieved by an electromagnetic driving apparatus for driving a valve of an internal combustion engine, which comprises a plunger holder fixedly secured to the valve and a plunger fixedly secured to said plunger holder. The plunger retaining a larger magnetic flux density than said plunger holder.

According to the present invention, the plunger allows more magnetic flux to flow than the plunger holder allows. Thus, the magnetic flux generated around the plunger tends to flow through the plunger. Therefore, the magnetic flux is efficiently concentrated to the plunger, and, thereby, the electromagnetic attractive force exerted on the plunger may be generated by a small amount of electric current.

A further object of the present invention is to provide an electromagnetic valve driving apparatus which can be operated by a small amount of electric current by using a plunger which is lightweight and has sufficient magnetic flux capacity to ensure proper operation.

The above-mentioned objects of the present invention are achieved by an electromagnetic driving apparatus for driving a valve of an internal combustion engine, which comprises a magnetic core having an inner portion and an outer portion and a plunger facing the magnetic core. The plunger is thicker in the middle portion which is located between the portions facing the inner portion and the outer portion of the magnetic core.

According to the present invention, a magnetic flux generated by the magnetic core flows into the plunger at a portion which faces the inner portion or the outer portion. The magnetic flux flowing into the plunger flows through the middle portion of the plunger and flows from the plunger at a portion which faces to the other one of the inner portion and the outer portion. Since the plunger has a sufficient thickness at the middle portion and has a thin thickness at the portions which face to respective the outer portion and the inner portion of the magnetic core, the plunger has a sufficient magnetic flux capacity while being a lightweight.

Other objects, features and advantages of the present invention will become more apparent from the following detailed description when read in conjunction with the accompanying drawings.

DESCRIPTION OF THE PREFERRED EMBODIMENTS

Figure 1:
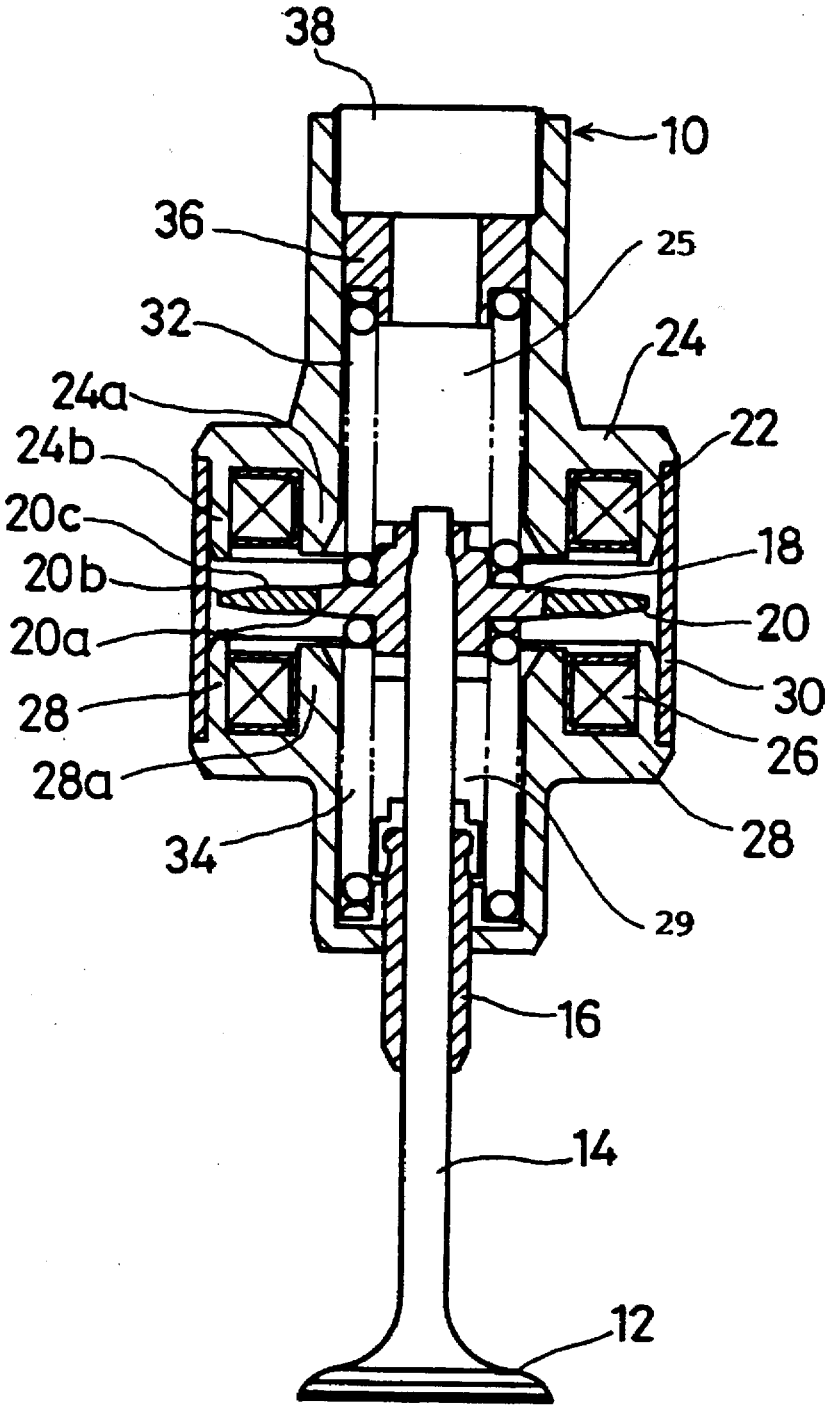
FIG. 1 is a cross-sectional view of an electromagnetic valve driving apparatus of an embodiment of the present invention.
Figure 2:
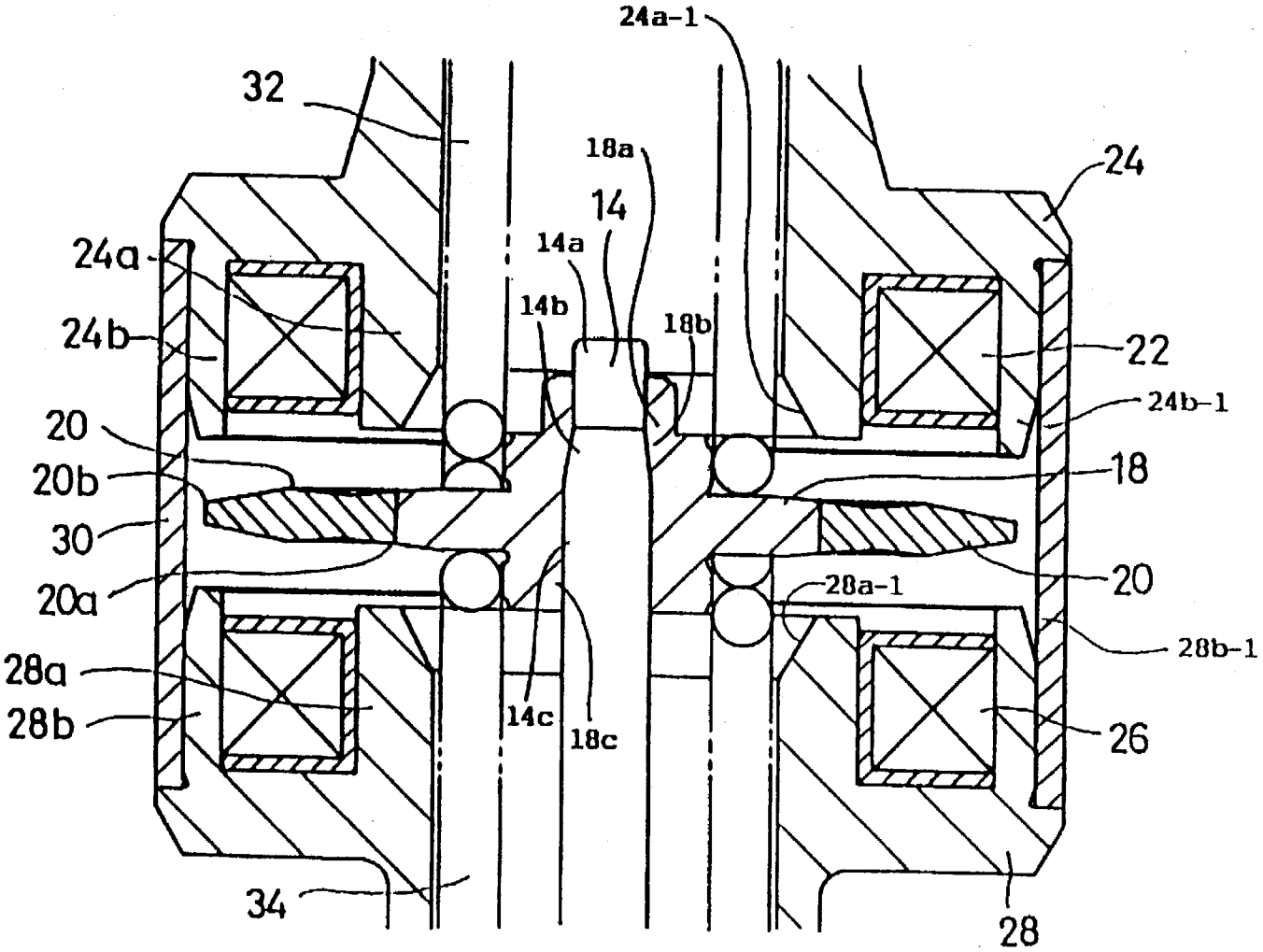
FIG. 2 is an enlarged cross-sectional view of a part of the electromagnetic valve driving apparatus shown in FIG. 1.

A description will now be given, with reference to FIG. 1 and FIG. 2, of an electromagnetic valve apparatus of an embodiment of the present invention. FIG. 1 is a cross-sectional view of the valve apparatus 10. FIG. 2 is an enlarged cross-sectional view of a part of the valve driving apparatus 10.

The valve driving apparatus 10 drives a valve 12. The valve 12 is used as an intake valve or an exhaust valve in an internal combustion engine. The valve 12 is placed in an intake port or an exhaust port of the engine so that a bottom surface thereof is exposed to a combustion chamber. That is, a cylinder head of the engine has ports, each of which is provided with a valve seat for the valve 12. The ports are opened or closed according to a reciprocal movement of the valve 12.

The valve 12 is supported by a valve rod 14 which is held by a valve guide 16. The valve rod 14 can reciprocate along the valve guide 16, and is fixed to a plunger holder 18 at an upper end thereof. The plunger holder 18 is formed of non-magnetic material. Light alloys, such as, Ti, Ti—Al, and Al, are preferable as material for the plunger holder 18.

As shown in FIG. 2, the valve rod 14 has a small diameter portion 14*a*, a taper portion 14*b*, and a large diameter portion 14*c* at the upper end thereof. On the other hand, the plunger holder 18 has a small diameter portion 18*a*, a taper portion 18*b*, and a large diameter portion 18*c*. The valve rod 14 and the plunger holder 18 are fixedly attached to each other by inserting the valve rod 14 into the plunger holder by press fitting until the small diameter portions 14*a*; 18*a*, the taper portions 14*b*; 18*b*, and the large diameter portions 14*c*; 18*c* are mated with each other.

When the taper portions 14*b*; 18*b* are made, the contact surface of the valve rod 14 and the plunger holder 18 are made larger and the length of a fitted portion of the valve rod 14 and the plunger holder 18 is made longer than the ones which are obtained in a case where the taper portion 14*b*; 18*b* are not made. Thereby, in this embodiment, enough connective strength can be obtained at the portion where the valve rod 14 and the plunger holder 18 are fixedly connected. Thus, the valve rod 14 is not easily separated from the plunger holder 18, and the valve rod 14 and the plunger holder 18 do not easily spin relative to one another.

The plunger holder 18 is secured to a plunger 20 at the periphery thereof. The plunger 20 is formed of a magnetic material which is made from magnetic metals, such as, Fe, Ni, and Co, and has a ring shape having a hole at the center thereof. The hole has substantially the same diameter as the plunger holder 18. The plunger 20 and the plunger holder 18 are secured to each other by any of various means, such as, electron beam welding, laser beam welding, and brazing. Incidentally, in a case where the plunger holder 18 is formed of a reinforced resin, insert molding and ultra sonic welding are suitable for securing the plunger 20 and the plunger holder 18.

A first solenoid coil 22 and a first magnetic core 24 are located above the plunger 20. On the other hand, a second solenoid coil 26 and a second magnetic core 28 are located below the plunger 20. The first and second magnetic cores 24 and 28 are formed of a magnetic material. The first magnetic core 24 holds the first solenoid coil 22, and the second magnetic core 28 holds the second solenoid coil 26. Moreover, the first magnetic core 24 and the second magnetic core 28 are supported by a yoke 30 which has a cylindrical shape. The yoke 30 is formed of non-magnetic material.

The first and second magnetic cores 24 and 28 have spring holes 25 and 29 extending in the axial direction of the valve apparatus 10 at the center portion thereof. A spring 32 is disposed inside the spring hole 25 and a spring 34 is disposed inside the spring hole 29.

One end of the spring 34 is fixed to the lower side of the plunger holder 18, and the other end is fixed to a lower end of the second magnetic core 28. One end of the spring 32 is fixed to the upper side of the plunger holder 18, and the other end is fixed to a stopper 36 which is disposed inside the spring hole 25. The stopper 36 is prevented from moving toward the upper side by an adjuster 38 which is screwed into the upper end of the first magnetic core 24.

Therefore, the plunger holder 18 is pressed by the springs 32 and 34 in opposite directions. Thus, the plunger holder 18 is positioned at a location in which the pressing force of the springs 32 and 34 is balanced. Moreover, the position of the adjuster 38 is adjusted so that the pressing force of the springs 32 and 34 is balanced when the plunger holder 18 is positioned in the middle of the first and second magnetic cores 24 and 28. Thus, in a state where no force except the pressing force of the springs 32 and 34 is exerted on the plunger holder 18, the plunger holder 18 and the plunger 20 is positioned at the middle of the first and second magnetic cores 24 and 28. When the plunger holder 18 and the plunger 20 are at that position, the valve 12 is in a neutral position of its stroke. Hereinafter, the position of the plunger holder 18 and the plunger 20 in this state will be called a neutral position.

Since the plunger 20 is formed of the magnetic material, when a current is supplied to the first solenoid coil 22 so as to generate a magnetic field around the first solenoid coil 22, a magnetic flux flows through a magnetic circuit comprising the first magnetic core 24, the plunger 20, and an air gap between the first magnetic core 24 and the plunger 20. When that magnetic flux is generated, an electromagnetic attractive force is exerted between the first magnetic core 24 and the plunger 20. Thus, in this situation, the plunger 20 moves toward the first magnetic core 24.

On the other hand, when a current is supplied to the second solenoid coil 26 so as to generate a magnetic field around the second solenoid coil 26, a magnetic flux flows through a magnetic circuit comprising the second magnetic core 28, the plunger 20, and an air gap between the second magnetic core 28 and the plunger 20. When that magnetic flux is generated, an electromagnetic attractive force is exerted between the second magnetic core 28 and the plunger 20. Thus, in this situation, the plunger 20 moves toward the second magnetic core 28.

Accordingly, if an appropriate current is alternately supplied to the first and second solenoid coils 22 and 26, the plunger 20 reciprocates between the first and second magnetic cores 24 and 28, and thereby, the valve 12 is reciprocated between an open and close state.

When the plunger 20 moves from the neutral position due to the electromagnetic attractive force, the springs 32 and 34 are elastically deformed or compressed. As a result, a return energy is stored in the springs 32 and 34. Thus, if the electromagnetic force is removed after the plunger 20 is displaced from the neutral position, a return force directed toward the neutral position is exerted on the plunger 20. Therefore, when friction loss due to movement of the valve 12 is ignored, the valve 12 reciprocates according to a simple harmonic motion.

In this case, the time T required to move the valve 12 from one end position to the other end position can be expressed by the following equation.

$$T=\pi\sqrt{(M/K)} \quad (1)$$

In the above equation (1), M indicates mass of the moving part of the valve driving apparatus 10, i.e., the sum of respective mass of the valve 12, valve rod 14, the plunger holder 18, and the plunger 20, and K indicates a total spring constant of the springs 32 and 34.

From the equation (1), it is followed that, to increase the response speed of the valve driving apparatus 10, it is necessary to lighten the mass M or to increase the spring constant K. On the other hand, to decrease power consumption, it is preferable to decrease the spring constant K because it is necessary to generate an electromagnetic attractive force which exceeds the pressing force generated by the springs 32 and 34 to make the valve driving apparatus 10 start operating or to hold the plunger 20 at an end position.

Accordingly, it is necessary to decrease the mass M and to decrease the spring constant K to realize a low power consumption and a high response speed. The plunger 20 of the valve driving apparatus 10 has a shape which permits the two conditions discussed above to be fulfilled.

Hereinafter, a description of a feature of the valve driving apparatus 10 will be given. When the number of turns of the first and second solenoid coils 22 and 26 is N, respectively, and the current flowing through each of the coils 22 and 26 is I, a magnetomotive force Ψ is expressed by the following equation.

$$\Psi=N\cdot I \quad (2)$$

As shown in equation (2), the magnetomotive force Ψ is determined based on N and I. N is a constant which is assigned based on the number of turns to the first and second solenoid coils 22 and 26. That is, the magnetomotive force Ψ which is generated by the current I is always the same when the current I is steady state. Therefore, to increase the electromagnetic attractive force which is generated by is the current I, it is necessary to increase the magnetic flux Φ which is generated by the magnetomotive force Ψ, and, moreover, to efficiently concentrate the magnetic flux Φ between the plunger 20 and the first and second magnetic cores 24 and 28. The requirement discussed above is satisfied by providing a magnetic circuit which has a low magnetic reactance and concentrates the magnetic flux Φ between the plunger 20 and the first and second magnetic cores 24 and 28.

When the plunger 20 is formed so that sufficient thickness is given to the portion in which the magnetic flux concentrates and less thickness is given to the portion in which the magnetic flux does not concentrate, it is possible to provide both a magnetic circuit as discussed above and to decrease the mass M of the moving part.

In this valve driving apparatus 10, the plunger holder 18 formed of the non-magnetic material is disposed inside of the plunger 20. Thus, the magnetic flux generated by the first or second solenoid coil 22 or 26 is retained inside the plunger 20. Therefore, the magnetic flux is efficiently concentrated in the air gaps formed in the flux circuits which connect the plunger 20 and the first or second magnetic core 24 or 28.

Moreover, the inner diameter of the plunger 20 is substantially the same as the mean value of the inner diameter and the outer diameter of the inner portions 24*a* and 28*a* which are formed radially inwardly of the first solenoid coil 22 of the first magnetic core 24 and the second solenoid coil 26 of the second magnetic core 28, respectively. The outer diameter of the plunger 20 is substantially the same as the mean value of the inner diameter and the outer diameter of the outer portions 24*b* and 28*b* which are formed radially outwardly of the first solenoid coil 22 of the first magnetic core 24 and the second solenoid coil 26 of the second magnetic core 28, respectively.

When the plunger 20 has such a shape discussed above, the magnetic flux Φ flowing from the first or the second magnetic core 24 or 28 is concentrated at the inner peripheral portion 20*a* or the outer peripheral portion 20*b* of the plunger 20 so as to flow into the plunger 20. The magnetic flux Φ flowing into the plunger 20 is concentrated at the outer peripheral portion 20*b* or the inner peripheral portion 20*a* so as to flow from the plunger 20 toward the first or the second magnetic core 24 or 28.

Incidentally, in the present embodiment, the inner edge of the inner portion 24*a* and 28*a*, and the outer edge of the outer portion 24*b* and 28*b* are chamfered to provide taper cut portions 24*a*-1, 24*b*-1, 28*a*-1, and 28*b*-1, as shown in FIG. 2. When the inner portion 24*a* and 28*a*, and the outer portion 24*b* and 28*b* have such taper cut portions 24*a*-1, 24*b*-1, 28*a*-1, and 28*b*-1, the magnetic flux Φ is prevented from expanding in the air gap. That is, according to the valve driving apparatus 10, the magnetic flux Φ is concentrated by not only the plunger 20 but also by the first and second magnetic cores 24 and 28.

in this embodiment, the plunger 20 is formed so that the thickness of the plunger 20 increases from the outer peripheral portion 20*b* to a middle portion 20*c*, as shown in FIG. 2. When the magnetic flux Φ is generated, the magnetic flux Φ flows into one of peripheral portions 20*a* and 20*b* of the plunger. Then, after flowing through the middle portion 20*c*, the magnetic flux Φ flows from the other peripheral portion 20*a* or 2O*b*. In this case, the magnetic flux Φ flows into or flows from the plunger 20 via a comparatively wide surface and flows through a comparatively narrow route at the middle portion 20*c*.

Therefore, it is required to give the middle portion 20*c* the biggest magnetic flux capacity among the portions of the plunger 20. As discussed above, the thickness of the plunger 20 increase toward the middle portion 20*c*. Thus, in this embodiment, the plunger 20 has sufficient magnetic flux capacity while being lightweight. According to the valve driving apparatus 10, since it is possible to decrease the mass M of the moving part of the valve driving apparatus 10, and to appropriately control the flow of the magnetic flux Φ, the power consumption of the valve driving apparatus 10 is substantially decreased.

Figure 3:
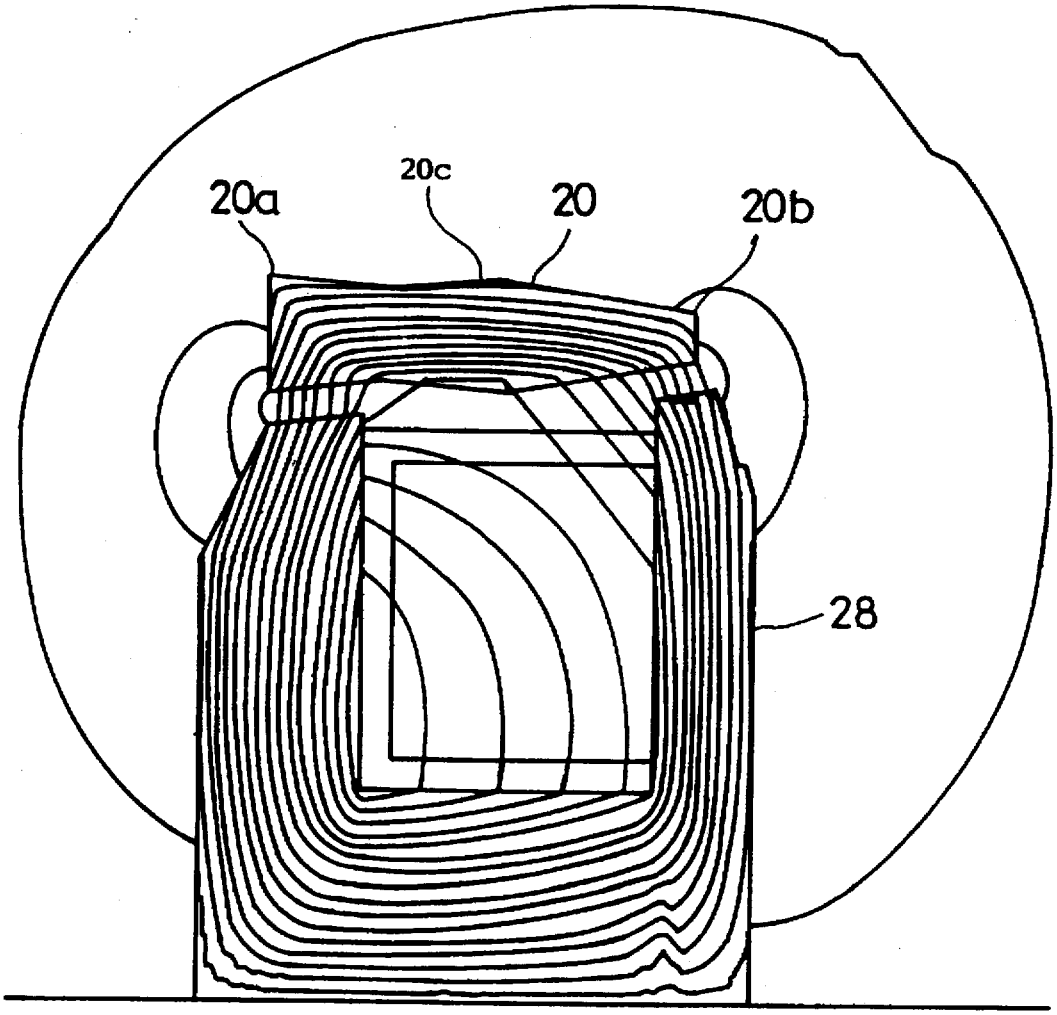
FIG. 3 is a cross-sectional view of a plunger and a magnetic core of the electromagnetic valve driving apparatus shown in FIG. 1 which shows magnetic flux lines flowing through the plunger and the magnetic core.
Figure 4:
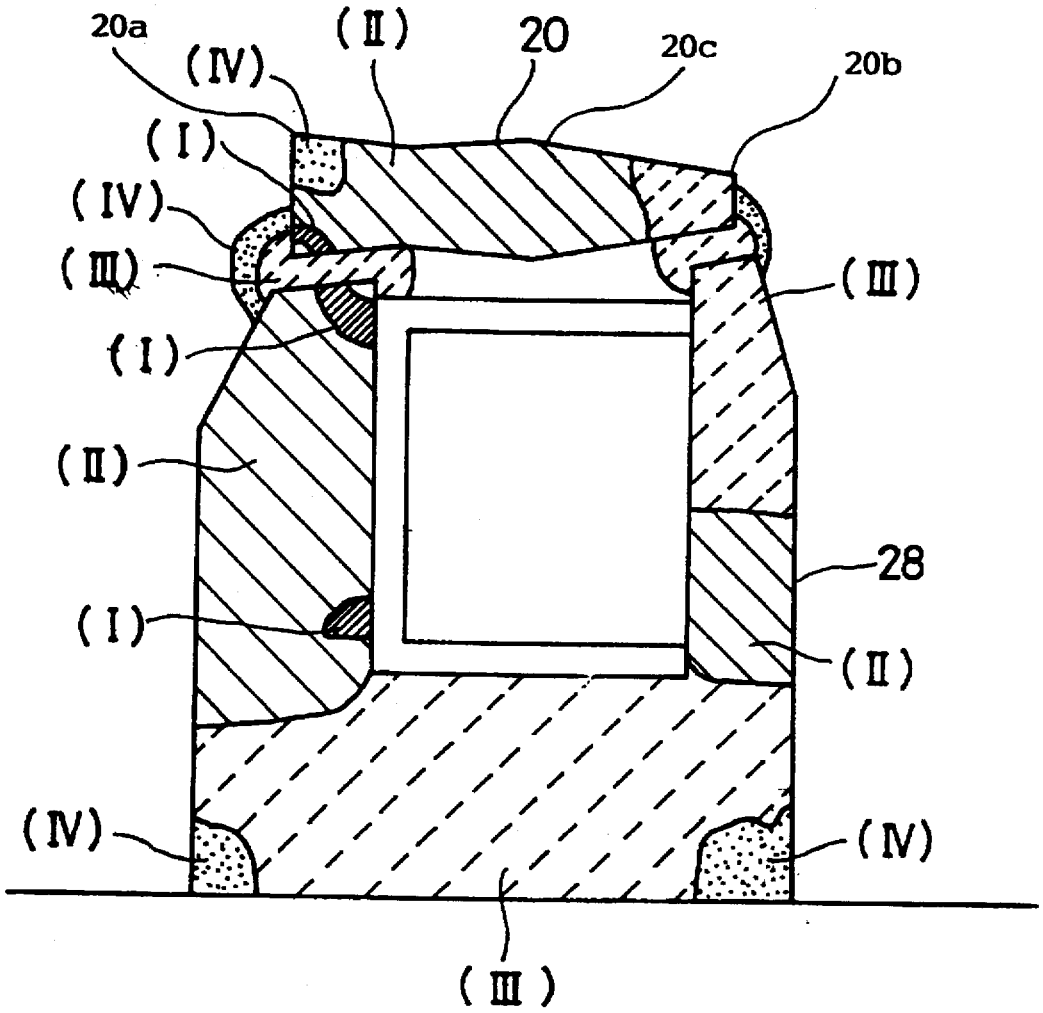
FIG. 4 is a cross-sectional view of the plunger and the magnetic core of the electromagnetic valve driving apparatus shown in FIG. 1 which shows a distribution of a magnetic-flux density formed in the plunger and the magnetic core.

FIG. 3 and FIG. 4 are enlarged cross-sectional views of the plunger 20 and the second magnetic core 28. FIG. 3 shows magnetic flux lines flowing through plunger 20 and the second magnetic core 28. FIG. 4 shows the distribution of the magnetic-flux density formed in the plunger 20 and the second magnetic core 28. In FIG. 4, each of the portions shown with reference No. (I)~(IV) indicates a portion in which the magnetic-flux density is substantially uniform. The magnetic-flux density decreases from portion (I) to the portion (IV), in that order.

The magnetic flux lines shown in FIG. 3 express that the magnetic flux Φ flows into or flows from the plunger 20 mainly near the inner peripheral portion 20*a* and near the outer peripheral portion 20*b*, and that the magnetic flux Φ is concentrated at the middle portion 20*c* more than at the other portions 20*a* and 20*b*. Moreover, the distribution shown in FIG. 4 expresses that the magnetic-flux density at the middle portion 20*c* is not very high compared with other portions 20*a* and 20*b*. That is, the results shown in FIG. 3 and FIG. 4 express that the magnetic flux flowing around the plunger 20 is appropriately concentrated at the portions where the plunger 20 and the second magnetic core 28 are closest to each other, and the magnetic flux Φ is prevented from saturating the middle portion 20*c*.

By designing the shape of the plunger 20 so that the plunger 20 has a maximum thickness at the middle portion 20*c*, the mass M of the plunger 20 can be decreased so as to make the plunger 20 lighter and the magnetic flux Φ can be prevented from saturating in the plunger 20. For satisfying the requirement discussed above, it is preferable that the plunger 20 has a shape having maximum thickness at the middle portion 20*c* and having minimum thickness at the inner peripheral portion 20*a* and the outer peripheral portion 20*b*.

However, to provide sufficient durability at the portion where the plunger 20 and the plunger holder 18 are joined, it is necessary to give appropriate thickness to the inner peripheral portion 20*a* of the plunger 20. Therefore, in the embodiment, as shown in FIG. 5, the shape of the plunger 20 is such that the thickness of the plunger 20 decreases in the diametrical direction from the middle portion 20*c* toward the center of the plunger 20 and then, the thickness increases in the diametrical direction toward the inner peripheral portion 20*a*.

Figure 5:
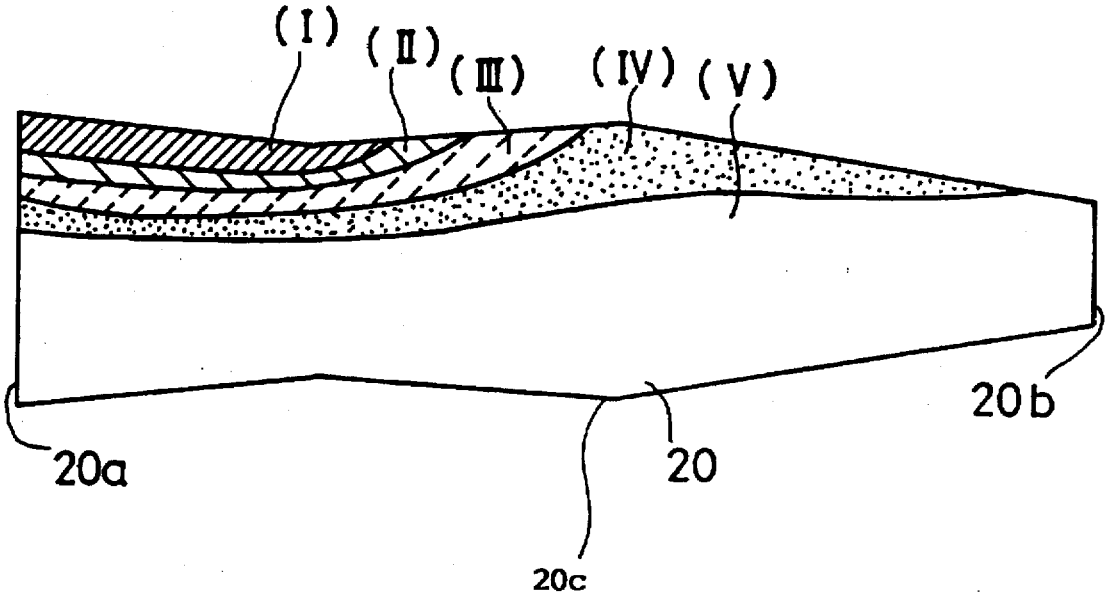
FIG. 5 is a cross-sectional view of the plunger of the electromagnetic valve driving apparatus shown in FIG. 1 which shows a distribution of a stress exerted on the plunger.

FIG. 5 shows the stress distribution generated in the plunger 20 when a downwardly directed force is exerted on the outer peripheral portion 20*b* in a situation when the inner peripheral portion 20*a* is fixed. Each of the portions shown in FIG. 5 with reference No. (I)~(V) indicates a portion in which the stress density is substantially uniform. The stress decreases from portion (I) to the portion (IV), in that order.

The distribution shown in FIG. 5 is generated when the electromagnetic attractive force is exerted between the plunger and the second magnetic core 28 because of the electromagnetic attractive force and the pressing force of the springs 32 and 34. As shown in FIG. 5, the maximum stress is exerted on the upper end of the inner peripheral portion 20*a* in this situation. On the other hand, when the electromagnetic attractive force is exerted between the plunger and the first magnetic core 24, the maximum stress is exerted on the lower end of the inner peripheral portion 20*a*.

To provide sufficient durability in the valve driving apparatus 10, it is necessary to provide an appropriate distance between the upper end and the lower end of the inner peripheral portion 20*a* of the plunger 20 so as to decrease the strain which is generated at the portion where the plunger 20 and the plunger holder 18 are joined. In the embodiment, the shape of the plunger 20 discussed above is designed to satisfy that requirement. Therefor, the valve driving apparatus 10 has sufficient durability at the portion where the plunger 20 and the plunger holder 18 are joined. Incidentally, in the embodiment, to provide sufficient magnetic flux capacity with the plunger 20, and to decrease the mass of the plunger 20, the thickness of the plunger 20 is changed so that the angle of the surface of the plunger 20 against the horizontal axis is in the range of 5° to 20°.

As shown in FIG. 5, stress exerted on the middle position of the inner peripheral portion 20*a* is not very large. In other words, the middle position of the inner peripheral portion 20*a* is not required to increase the durability of the joined portion. Thus, the durability of the joined portion can be obtained by only providing an appropriate distance between the upper end and the lower end of the inner peripheral portion 20*a*.

Figure 6:
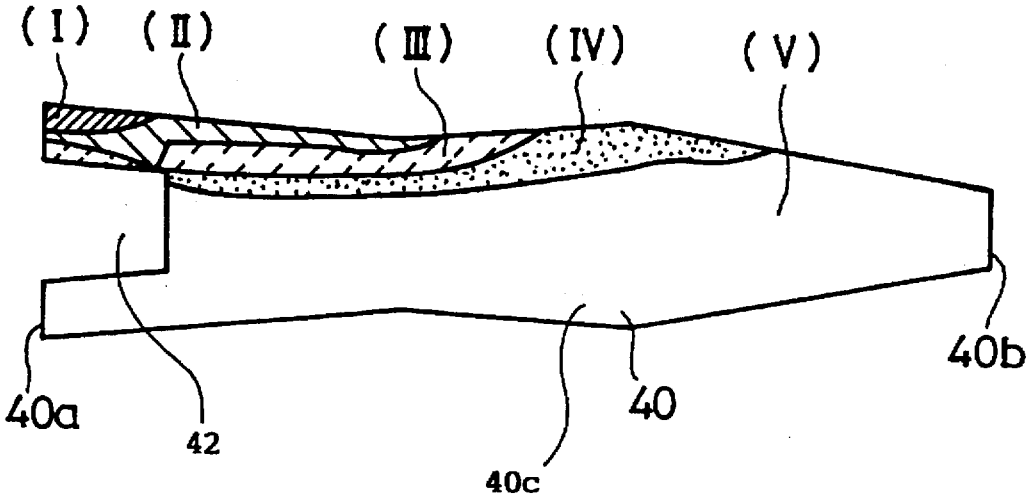
FIG. 6 is a cross-sectional view of a plunger of an electromagnetic valve driving apparatus of a second embodiment of the present invention which shows a distribution of a stress exerted on the plunger.

FIG. 6 is a cross-sectional view of a plunger 40 of a second embodiment of the present invention. As shown in FIG. 6, the plunger 40 has a cut-out portion 42 at the inner periphery thereof, namely, between the upper end and the lower end of the inner peripheral portion 40*a*.

Moreover, FIG. 6 shows stress distribution generated in the plunger 40 when a downwardly directed force is exerted on the outer peripheral portion 40*b* in a situation when the inner peripheral portion 40*a* is fixed. Bach of the portions shown in FIG. 5 with reference No. (I)~(V) indicates a portion in which the stress density is substantially uniform. The stress decreases from portion (I) to the portion (V), in that order.

As shown in FIG. 6, the distribution of the stress generated in the plunger 40 is substantially the same as that generated in the plunger 20. Accordingly, the plunger 40 and the plunger holder 18 have the same durability as the plunger 20 at the joined portion.

Moreover, since the plunger 40 has the cut-out portion 40, the mass of the plunger 40 is less than the plunger 20. Therefore, if the valve driving apparatus 10 uses the plunger 40 instead of the plunger 20, the mass M of the moving part of the valve driving apparatus 10, can be decreased and, thereby, the power consumption of the valve driving apparatus 10 is further decreased.

In the valve driving apparatus 10, the material of the plunger holder 18 is limited to non-magnetic material. However, the plunger holder 18 can be formed of materials which allow less magnetic flux to flow than the plunger 20 and material which has a lower saturation magnetic flux density than the plunger 20.

The present invention is not limited to the specifically disclosed embodiments, and variations and modifications may be made without departing from the scope of the present invention.

What is claimed is:

1. An electromagnetic valve driving apparatus for driving a valve of an internal combustion engine by an electromagnetic attractive force, said valve driving apparatus comprising:

a plunger holder formed of a first material fixedly secured to said valve; and a plunger having a through hole which has a diameter substantially the same as an outer diameter of an outermost circumferential portion of said plunger holder, wherein an inner circumference of said plunger is fixedly secured to the outermost circumferential portion of said plunger holder and wherein the plunger is formed of a second material having a higher magnetic property than said first material.

2. The electromagnetic valve driving apparatus as claimed in claim 1, wherein a cut-out portion is formed in one end of the plunger, the cut-out portion defining an inner periphery which is substantially concentric to an outer periphery of said plunger holder.

3. The electromagnetic valve driving apparatus as claimed in claim 1, further comprising a magnetic core including an inner portion and an outer portion facing said plunger; and wherein said plunger has at least one of an inner peripheral portion which faces the middle portion of said inner portion and an outer peripheral portion which faces the middle portion of said outer portion.

4. The electromagnetic valve driving apparatus as claimed in claim 2, further comprising a magnetic core including an inner portion and an outer portion facing said plunger; and wherein said plunger has at least one of an inner peripheral portion which faces the middle portion of said inner portion and an outer peripheral portion which faces the middle portion of said outer portion.

5. The electromagnetic valve driving apparatus as claim in claim 3, wherein said magnetic core has a taper cut portion at least at one of an inner edge of said inner portion and an outer edge of said outer portion.

6. The electromagnetic valve driving apparatus as claim in claim 4, wherein said magnetic core has a taper cut portion at least at one of an inner edge of said inner portion and an outer edge of said outer portion.

7. An electromagnetic valve driving apparatus for driving a valve of an internal combustion engine by an electromagnetic attractive force, said valve driving apparatus comprising:

a plunger holder fixedly secured to said valve;

a plunger fixedly secured to said plunger holder, a magnetic flux retained by said plunger being larger than a magnetic flux retained by said plunger holder, wherein an inner periphery of said plunger is substantially concentric with said plunger holder and wherein said plunger has a thickness which increases in a diametrical direction from an outer periphery toward a middle portion thereof.

8. The electromagnetic valve driving apparatus as claimed in claim 7, wherein said plunger has a cut-out portion at an inner periphery.

9. The electromagnetic valve driving apparatus as claimed in claim 7, wherein said middle portion and said inner periphery are thicker than a portion located between said middle portion and said inner periphery.

10. The electromagnetic valve driving apparatus as claimed in claim 9, wherein said plunger has a cut-out portion at said inner periphery.

11. The electromagnetic valve driving apparatus as claimed in claim 7, further comprising a magnetic core including an inner portion and an outer portion facing said plunger; and wherein said plunger has at least one of an inner peripheral portion which faces the middle portion of said inner portion and an outer peripheral portion which faces the middle portion of said outer portion.

12. The electromagnetic valve driving apparatus as claimed in claim 8, further comprising a magnetic core including an inner portion and an outer portion facing said plunger; and wherein said plunger has at least one of an inner peripheral portion which faces the middle portion of said inner portion and an outer peripheral portion which faces the middle portion of said outer portion.

13. The electromagnetic valve driving apparatus as claimed in claim 9, further comprising a magnetic core including an inner portion and an outer portion facing said plunger; and wherein said plunger has at least one of an inner peripheral portion which faces the middle portion of said inner portion and an outer peripheral portion which faces the middle portion of said outer portion.

14. The electromagnetic valve driving apparatus as claimed in claim 10, further comprising a magnetic core including an inner portion and an outer portion facing said plunger; and wherein said plunger has at least one of an inner peripheral portion which faces the middle portion of said inner portion and an outer peripheral portion which faces the middle portion of said outer portion.

15. The electromagnetic valve driving apparatus as claim in claim 11, wherein said magnetic core has a taper cut portions at least at one of an inner edge of said inner portion and an outer edge of said outer portion.

16. The electromagnetic valve driving apparatus as claim in claim 12, wherein said magnetic core has a taper cut portion at least at one of an inner edge of said inner portion and an outer edge of said outer portion.

17. The electromagnetic valve driving apparatus as claim in claim 13, wherein said magnetic core has a taper cut portion at least at one of an inner edge of said inner portion and an outer edge of said outer portion.

18. The electromagnetic valve driving apparatus as claim in claim 14, wherein said magnetic core has a taper cut portion at least at one of an inner edge of said inner portion and an outer edge of said outer portion.

19. An electromagnetic valve driving apparatus for driving a valve of an internal combustion engine by an electromagnetic attractive force, said valve driving apparatus comprising:

a solenoid coil extending around a central axis and defining an inner circumference and an outer circumference;

a magnetic core having an inner portion located within the inner circumference and an outer portion located outside the outer circumference; and a plunger facing said solenoid coil and said magnetic core so that a middle portion of the plunger faces the solenoid coil and inner and outer portions of the plunger face the inner and outer portions of said magnetic core, respectively, wherein a thickness of the middle portion of said plunger is greater than a thickness of the inner and outer portions of the plunger.

20. An apparatus for driving a valve of an internal combustion engine by an electromagnetic attractive force comprising:

a plunger holder formed of a first material coupled to the valve, wherein the plunger holder extends radially outward from a central axis to an outer periphery;

a plunger coupled around the outer periphery of the plunger holder, wherein the plunger is formed of a second material more strongly affected by magnetic forces than the first material.

21. The apparatus according to claim 20, wherein the plunger extends radially outward from an inner periphery coupled to the outer periphery of the plunger holder to an outer edge and wherein a thickness of the plunger in a direction substantially parallel to the central axis is greatest in a middle portion between the outer edge and the inner periphery.

* * * * *

UNITED STATES PATENT AND TRADEMARK OFFICE

CERTIFICATE OF CORRECTION

PATENT NO. : 5,690,064

DATED : November 25, 1997

INVENTOR(S) : Takashi IZUO

It is certified that error appears in the above-indentified patent and that said Letters Patent is hereby corrected as shown below:

Column 1, line 33, change "an" to --a--.

Column 2, line 16, after "holder" delete the period, insert a comma, and change "The" to --the--.

Column 2, line 47, delete "to" and change "respective the" to --the respective--.

Column 2, line 49, delete "a".

Column 3, line 49, change "portion" to --portions--.

Column 4, line 65, change "close" to --closed--.

Column 6, line 42, change "other" to --outer--.

Column 6, line 43, change "20b" to --20b--.

Column 6, line 50, change "increase" to --increases--.

Column 7, line 58, change "Therefor," to --Therefore,--.

Column 8, line 14, change "Bach" to --Each--.

UNITED STATES PATENT AND TRADEMARK OFFICE

CERTIFICATE OF CORRECTION

PATENT NO. : 5,690,064

DATED : November 25, 1997

INVENTOR(S) : Takashi IZUO

It is certified that error appears in the above-indentified patent and that said Letters Patent is hereby corrected as shown below:

Column 9, line 8, change "claim" to --claimed--.

Column 9, line 12, change "claim" to --claimed--.

Column 10, line 9, change "claim" to --claimed--.

Column 10, line 14, change "claim" to --claimed--.

Column 10, line 18, change "claim" to --claimed--.

Column 10, line 22, change "claim" to --claimed--.

Signed and Sealed this

First Day of September, 1998

Bruce Lehman

*Attest:*

BRUCE LEHMAN

*Attesting Officer*

*Commissioner of Patents and Trademarks*